US010126083B2

(12) United States Patent
Groves

(10) Patent No.: US 10,126,083 B2
(45) Date of Patent: Nov. 13, 2018

(54) FIREARM SUPPRESSOR AND METHOD OF OPERATION

(71) Applicant: Greyson Blaine Groves, Dundas (CA)

(72) Inventor: Greyson Blaine Groves, Dundas (CA)

(73) Assignee: CANADA IP HOLDING PARTNERSHIP, Ontario (CA)

( * ) Notice: Subject to any disclaimer, the term of this patent is extended or adjusted under 35 U.S.C. 154(b) by 0 days.

(21) Appl. No.: 15/359,027

(22) Filed: Nov. 22, 2016

(65) Prior Publication Data

US 2017/0146312 A1 May 25, 2017

(30) Foreign Application Priority Data

Nov. 23, 2015 (CA) ..... 2913248

(51) Int. Cl.
*F41A 21/30* (2006.01)
*F41A 21/34* (2006.01)
*F41A 21/36* (2006.01)

(52) U.S. Cl.
CPC ..... *F41A 21/30* (2013.01); *F41A 21/34* (2013.01); *F41A 21/36* (2013.01)

(58) Field of Classification Search
None
See application file for complete search history.

(56) References Cited

U.S. PATENT DOCUMENTS

| | | | | |
|---|---|---|---|---|
| 2,351,037 | A * | 6/1944 | Green | F41A 21/34 89/14.5 |
| 3,115,060 | A | 12/1963 | Ashbrook et al. | |
| 6,575,074 | B1 | 6/2003 | Gaddini | |
| 7,832,323 | B1 | 11/2010 | Davies | |
| 2015/0192379 | A1 | 7/2015 | Larson | |
| 2015/0285575 | A1 | 10/2015 | Sclafani | |
| 2016/0109205 | A1* | 4/2016 | Coppinger | F41A 21/30 89/14.4 |
| 2017/0067711 | A1* | 3/2017 | Slack | F41A 21/30 |

FOREIGN PATENT DOCUMENTS

WO WO 2007/069086 * 6/2007

OTHER PUBLICATIONS

European Search Report for Application No. EP 16 20 0155.

* cited by examiner

*Primary Examiner* — Stephen Johnson
(74) *Attorney, Agent, or Firm* — Cantor Colburn LLP

(57) ABSTRACT

A suppressor assembly for use with a firearm is disclosed herein. The suppressor having: a baffle; a rear seal plate; a housing; and a front end cap, wherein the housing, the rear seal plate and the front end cap define an expansion chamber for receipt of expansion gases received from the baffle.

16 Claims, 9 Drawing Sheets

FIREARM SUPPRESSOR AND METHOD OF OPERATION

CROSS-REFERENCE TO RELATED APPLICATIONS

This application claims foreign priority under 35 U.S.C. § 119 to Canadian Patent Application No. 2,913,248 filed on Nov. 23, 2015, the entire contents of which are incorporated herein by reference thereto.

FIELD OF THE INVENTION

The present invention relates generally to firearms or projectile launching devices. More particularly, the present invention relates to a suppressor for reducing the audible report and visible signature that results from the discharge of a firearm or projectile launching device.

BACKGROUND OF THE INVENTION

The discharge of a firearm produces high temperature propellant gases, which rapidly expand into the surrounding air as they exit the muzzle of the firearm. The propellant gases often carry residual, unburned propellant powder, which may ignite when it mixes with the oxygen-rich ambient air. The resulting combustion produces a flash of light, known as muzzle flash. Muzzle flash can be detrimental to a firearm user, as it can be used to locate the position of the firearm user and may interfere with the firearm's sighting system, particularly in low-light conditions.

In addition, the discharge of the firearm typically produces an audible report and other secondary effects including but not limited to: a gas flow field exiting the muzzle of a firearm; environmental dust or debris clouds generated by the gas flow field; movement of surrounding environmental elements such as vegetation, rubbish or easily disturbed items; and expelled propellant gases 'smoke' from the ammunition of the firearm.

Accordingly, it is desirable to provide a suppressor for a firearm that mitigates audible and visual indicators of the firearm when it has been discharged.

SUMMARY OF THE INVENTION

In one embodiment, a suppressor assembly for use with a firearm is provided. The suppressor having: a baffle; a rear seal plate; a housing; and a front end cap, wherein the housing, the rear seal plate and the front end cap define an expansion chamber for receipt of expansion gases received from the baffle.

In addition to one or more of the features described above, or as an alternative to any of the foregoing embodiments, the baffle may have a monolithic cone shape that increases in diameter as it extends forwardly towards, the front end cap.

In addition to one or more of the features described above, or as an alternative to any of the foregoing embodiments, the baffle may have a concentric bore extending therethrough from a threaded opening and wherein the baffle also has a series of annular passageways that each connect the concentric bore with a tapered exterior surface of the baffle.

In addition to one or more of the features described above, or as an alternative to any of the foregoing embodiments, the annular passageways may be axially inclined rearward with respect to a rearward end of the baffle.

In addition to one or more of the features described above, or as an alternative to any of the foregoing embodiments, the series of annular passageways may be 4 annular passageways that repeat in a pattern axially about the bore of the baffle.

In addition to one or more of the features described above, or as an alternative to any of the foregoing embodiments, the annular passageways may be separated by a plurality of wall portions that reduce sequentially in thickness from a rearward end of the baffle.

In addition to one or more of the features described above, or as an alternative to any of the foregoing embodiments, the front end cap may be integrally formed with the baffle.

In addition to one or more of the features described above, or as an alternative to any of the foregoing embodiments, the baffle may be formed from a single monolithic piece.

In yet another embodiment, a suppressor assembly and a firearm with a barrel are provided. The suppressor assembly having: a baffle in fluid communication with a muzzle end of the barrel; a rear seal plate secured to a step feature of the barrel; a housing; and a front end cap, wherein the housing, the rear seal plate and the front end cap define an expansion chamber for receipt of expansion gases received from the baffle.

In addition to one or more of the features described above, or as an alternative to any of the foregoing embodiments, the baffle may have a monolithic cone shape that increases in diameter as it extends forwardly from the muzzle end of the barrel towards the front end cap.

In addition to one or more of the features described above, or as an alternative to any of the foregoing embodiments, the baffle may have a concentric bore extending therethrough from a threaded opening and wherein the baffle also has a series of annular passageways that each connect the concentric bore with a tapered exterior surface of the baffle.

In addition to one or more of the features described above, or as an alternative to any of the foregoing embodiments, the series of annular passageways may be axially inclined rearward with respect to a rearward end of the baffle.

In addition to one or more of the features described above, or as an alternative to any of the foregoing embodiments, the series of annular passageways comprise 4 annular passageways that repeat in a pattern axially about the bore of the baffle.

In addition to one or more of the features described above, or as an alternative to any of the foregoing embodiments, the annular passageways are separated by a plurality of wall portions that reduce sequentially in thickness from a rearward end of the baffle.

In addition to one or more of the features described above, or as an alternative to any of the foregoing embodiments, the annular passageways are separated by a plurality of wall portions that reduce sequentially in thickness from a rearward end of the baffle.

In addition to one or more of the features described above, or as an alternative to any of the foregoing embodiments, the front end cap is integrally formed with the baffle.

In addition to one or more of the features described above, or as an alternative to any of the foregoing embodiments, the baffle is formed from a single monolithic piece.

In addition to one or more of the features described above, or as an alternative to any of the foregoing embodiments, the rear seal plate has a "U" shaped configuration that surrounds a central opening that is secured to step feature of a barrel.

In addition to one or more of the features described above, or as an alternative to any of the foregoing embodiments, the rear seal plate has a ledge that is welded to the housing of the suppressor assembly.

In yet another embodiment, a method for suppressing muzzle flash of a firearm is provided. The method including the steps of: directing combustion gases of the firearm rearwardly from a muzzle end of a barrel of the firearm into an expansion chamber located about the barrel through a baffle secured to the muzzle end of the barrel, wherein the baffle has a monolithic cone shape that increases in diameter as it extends forwardly towards a front end cap secured to the baffle and a housing that defines the expansion chamber.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the invention will now be described, by way of example only, with reference to the attached Figures, wherein.

DETAILED DESCRIPTION

Disclosed herein is a device known as a 'suppressor', which is common vernacular for a person skilled in the art of firearms and related accessories. The purpose of a suppressor is to achieve any combination of the following: 1) reduce the audible report of a firearm for the purpose of, the may mitigate damage to the hearing of the user and surrounding personnel as well as reduce audible position disclosing effects of the operation of the firearm; 2) reduce the visible flash signature of a firearm; and 3) reduce the position disclosing secondary effects of the gas flow field exiting the muzzle of a firearm including; environmental dust or debris clouds generated by gas flow field, movement of surrounding environmental elements such as vegetation, rubbish or easily disturbed items, and expelled propellant gases 'smoke' from the ammunition of the firearm.

The intended purpose of the device is not limited to any particular type of firearm. Its applications are envisaged on the following firearms including but not limited to, bolt action rifles, pistols, sub machineguns, carbines, assault rifles, bolt action rifles, lever action rifles, light support weapons, shotguns, machine guns, grenade launchers, anti-materiel weapons and others.

Figure 1:
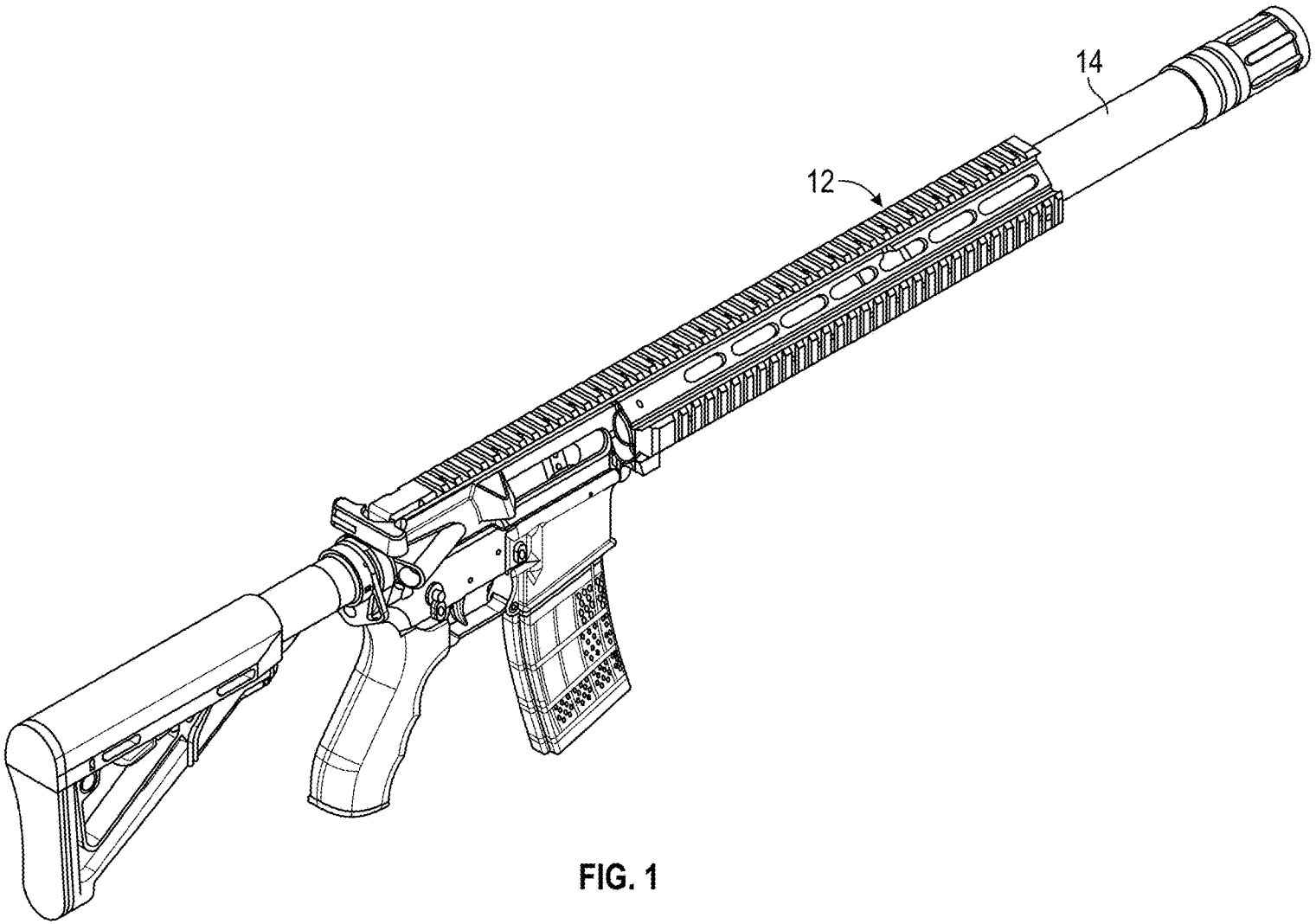
FIG. 1 is a perspective view of a firearm without a suppressor.

Referring now to the FIGS. a suppressor or suppressor assembly 10 in accordance with various embodiments of the present invention is disclosed. In one embodiment, the suppressor or suppressor assembly 10 may be configured for use with a firearm 12 illustrated in FIGS. 1 and 2. In various non-limiting embodiments the firearm 12 may be anyone of gas operated, piston or hybrid, automatic or semi-automatic, non-limiting examples include the bolt action rifles, pistols, sub machineguns, carbines, assault rifles, bolt action rifles, lever action rifles, light support weapons, shotguns, machine guns, grenade launchers, anti-materiel weapons and others. FIG. 1 illustrates the rifle 12 without the suppressor or suppressor assembly 10 and FIG. 2 illustrates the suppressor 10 secured to a barrel 14 of the rifle 12.

Figure 3A:
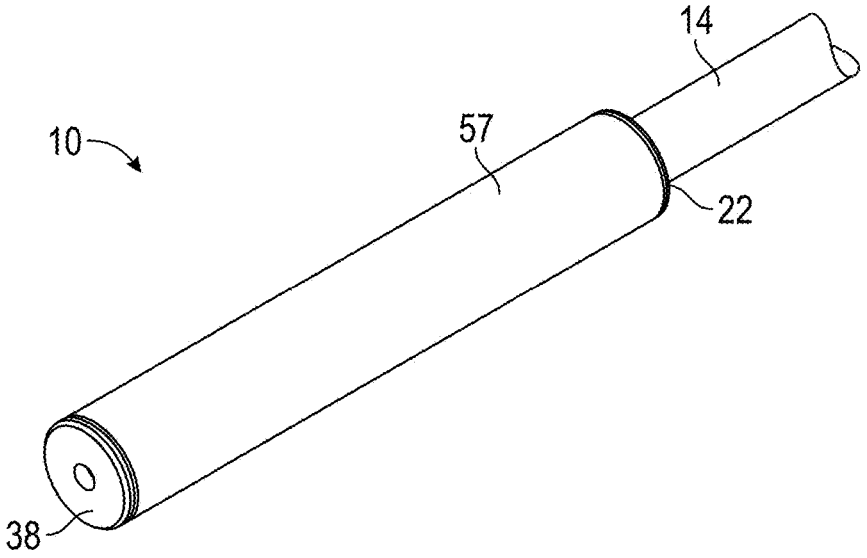
FIG. 3A is an external view of the suppressor installed on a barrel.
Figure 3B:
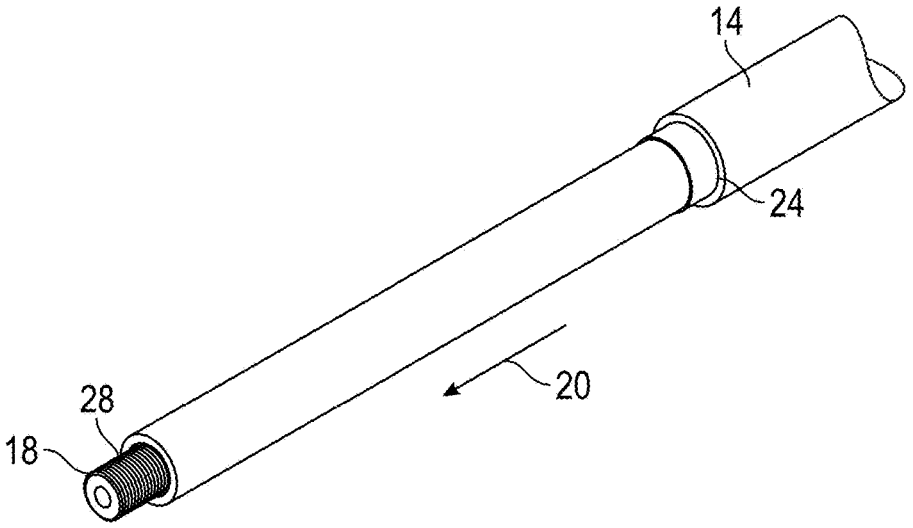
FIG. 3B is a view of the barrel without the suppressor.

FIG. 3A illustrates an external view of the suppressor or suppressor assembly 10 installed on the barrel 14 while FIG. 3B illustrates the barrel 14 without the suppressor or suppressor assembly 10. In one embodiment, the suppressor or suppressor assembly 10 includes a baffle 16 that is secured to a forward end or muzzle 18 of the barrel 14. The baffle 16 according to at least one embodiment is at least illustrated in FIGS. 4A-4G, 5 and 5A. Arrow 20 illustrates the muzzle direction of the barrel 14.

Figure 2:
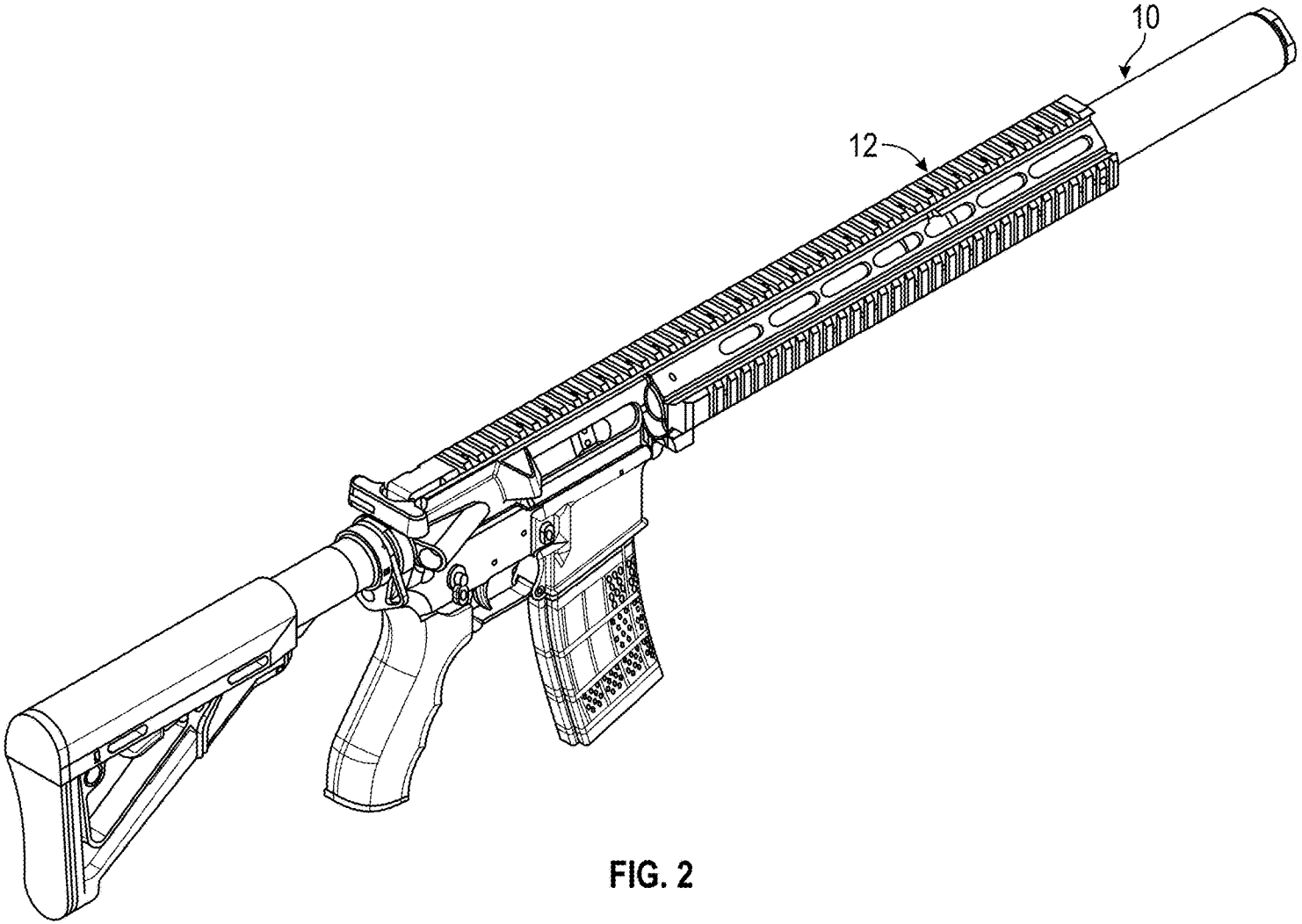
FIG. 2 is a perspective view of the firearm of FIG. 1 with a suppressor.

In one embodiment, the suppressor or suppressor assembly 10 includes a rear seal plate 22 that is installed onto the barrel by sliding it over the barrel 14 until it reaches a step feature 24 in the barrel or an ancillary component of the barrel assembly such as a gas block 26 (illustrated in FIGS. 1 and 2). In one embodiment, the rear seal plate 22 has a "U" shaped configuration 21 that surrounds a central opening 23 that is secured to step feature 24 by for example a welding or equivalent process. See at least FIGS. 5 and 5B. In an alternative embodiment and as illustrated in FIG. 6, the rear seal plate 22 may have a ledge or flange 25 that is welded to suppressor assembly 10.

The forward end or muzzle 18 of the barrel 14 is configured to have a plurality of threads 28 at the muzzle 18 in order to engage a threaded opening 30 of the baffle 16. Accordingly, the baffle 16 is attached to the barrel 14 via threading engagement. Of course, other types of securement are considered to be within the scope of various embodiments of the present invention.

In one embodiment, a rearward end 29 of the baffle 16 is provided with flattened portions 31 so that a tool can be applied to flattened portions 31, for applying additional torque during the mounting or unmounting of the baffle 16 to the muzzle 18 of the barrel 14.

In one embodiment and as illustrated in the attached FIGS., the baffle 16 has a monolithic cone shape that increases in diameter as it extends forwardly from the muzzle end 18 of the barrel 14. The baffle 16 also has a concentric bore 32 extending therethrough from threaded opening 30. The bore 32 has a diameter that is greater than a diameter of a projectile or round of the firearm 12 that is propelled forwardly through a bore 27 of the barrel 14. In addition, the baffle 16 also has a series of annular passageways 34 that each connect the center bore 32 with a tapered exterior surface 36 of the cone shaped baffle 16. In other words, passageways 34 provide fluid communication to bore 32. In accordance with various embodiments of the present invention there are several features of these passageways 34. For example and where the annular passageways 34 meet the bore 32, the conical passageway has a radius transition in axial parallel cross section, toroidal form. These passageways 34 are axially inclined rearward with respect to the muzzle 18 of the barrel 14 to encourage rearward movement of the escaping gases during the discharge of a round of the rifle 12. This rearward movement of the escaping gases is illustrated by arrows 38 in at least FIG. 5. The angle of inclination of the passageways 34 with respect to a center line 39 of the barrel 14 may optimized depending on the bore 27 of the rifle 12 and/or the type of round being fired.

These annular passageways 34 may be repeated in a pattern axially about the bore 32 of the baffle 16. In one embodiment, a series of four passageways 34 are provided however, the number and configuration of the passageways may be optimized based on ammunition, performance, caliber or other factors.

In one embodiment, the pattern of the annular passageways 34 may vary or have an inconsistent axial interval. Alternatively, the annular passageways 34 may have a consistent axial interval. In one embodiment, the material of a first 'wall' 40 between a first passage 42 and a second passage 44 is thicker than subsequent walls 46, 48 and 50 located between second passage 44 and a third passage 52 and a fourth passage 54 respectively. This reduction in wall thickness helps minimize the overall weight of the baffle 16 while optimizing the service life of the whole baffle assembly by maintaining a minimal wall thickness suitable for the various calibers of the rounds used with the suppressor 10.

Figure 4A:
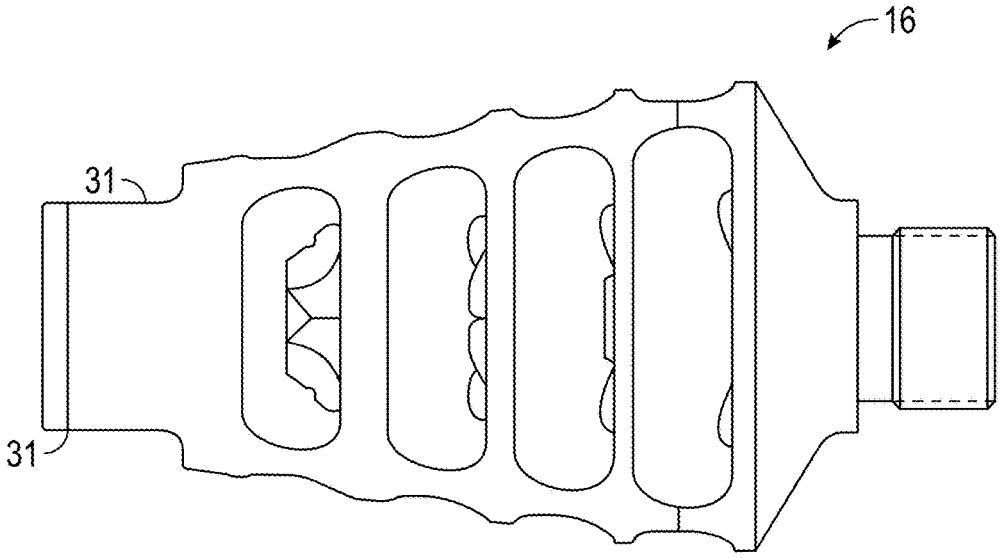
FIGS. 4A and 4B are side views of a baffle of the suppressor.
Figure 4B:
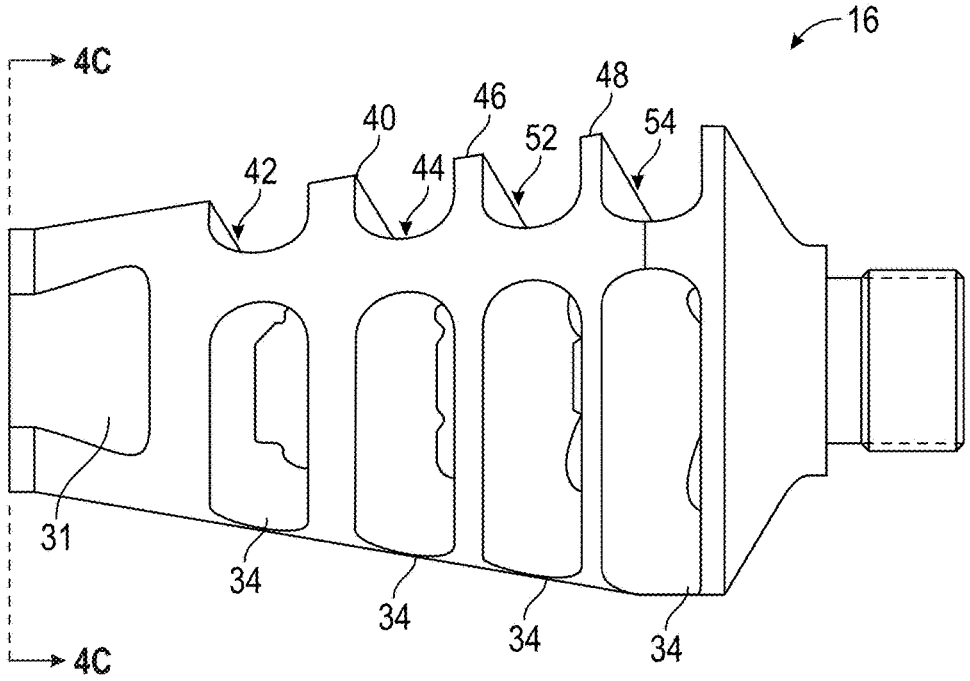
Figure 4C:
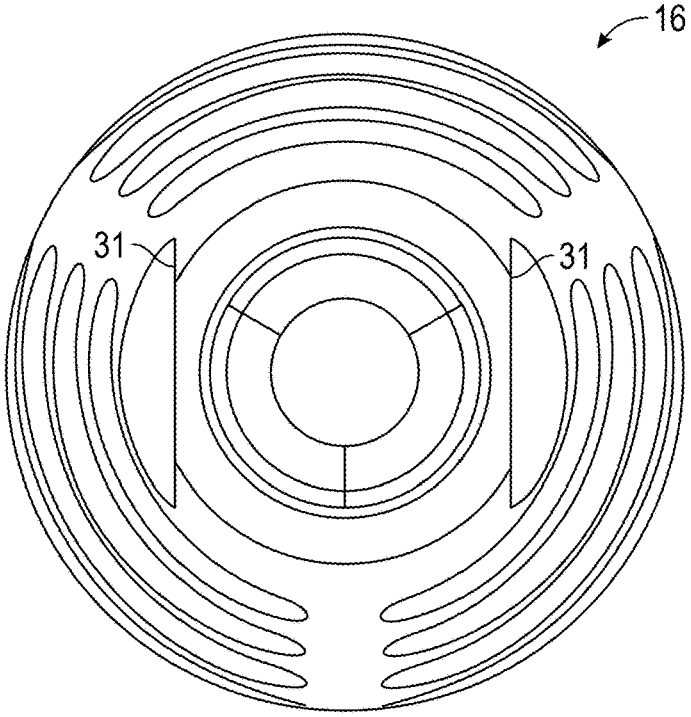
FIG. 4C is a view along lines 4C-4C of FIG. 4B.
Figure 4D:
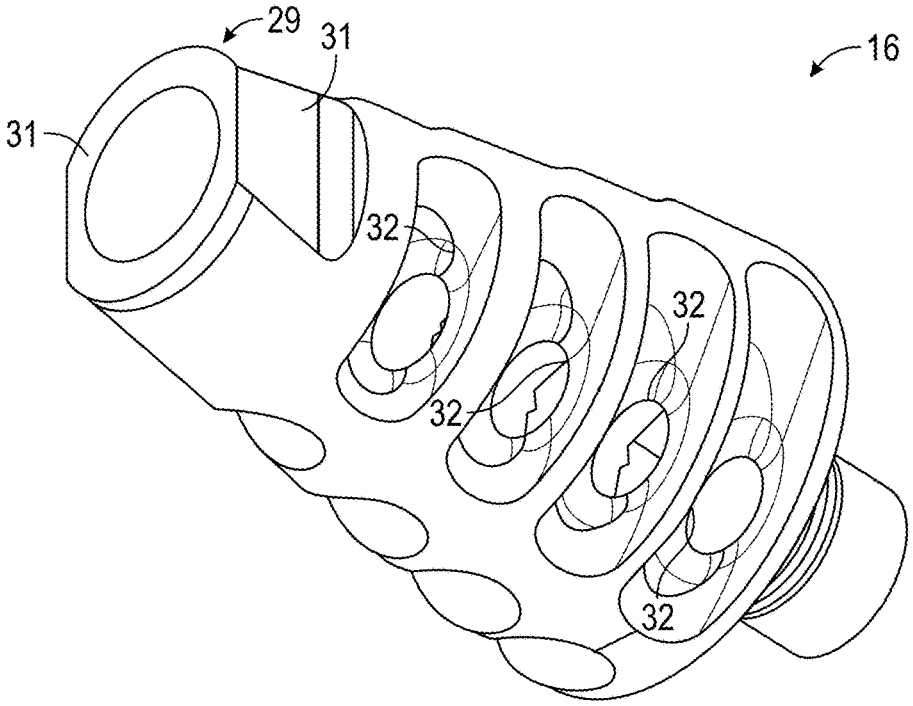
FIGS. 4D and 4E are perspective views of the baffle of the suppressor.
Figure 4E:
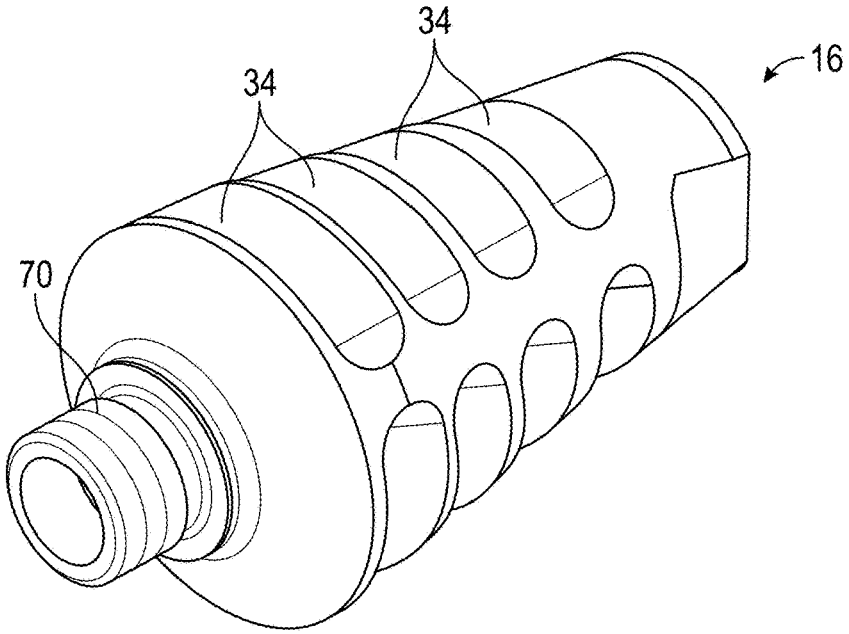
Figure 4F:
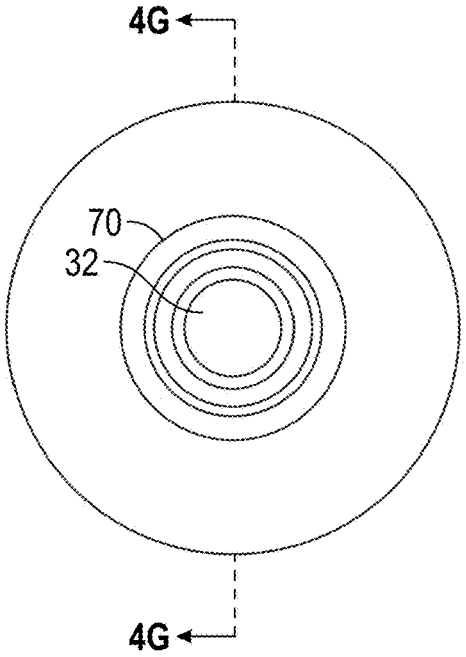
FIG. 4F is an end view of the baffle of the suppressor.
Figure 4G:
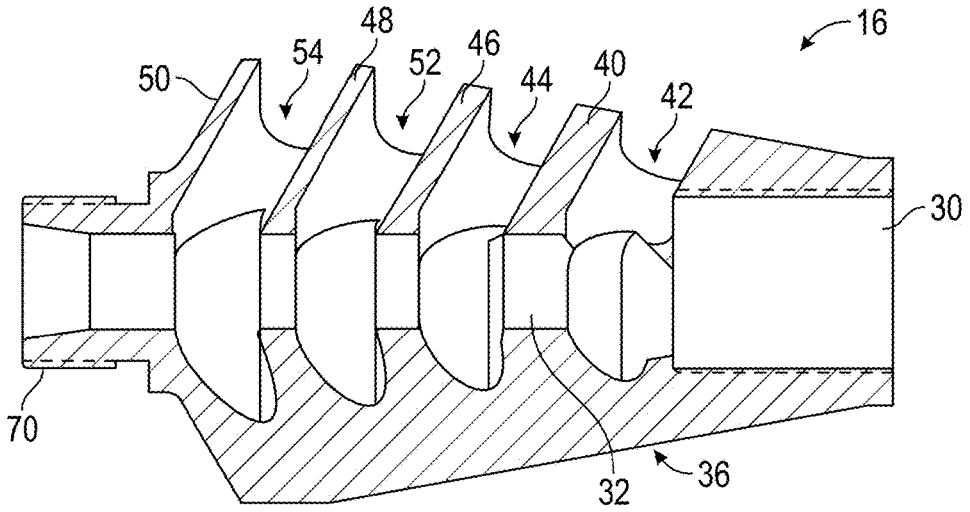
FIG. 4G is a view along lines 4G-4G of FIG. 4F.

In one embodiment, the axial pattern of the four openings 34 is repeated 3 times in a radial pattern about the baffle 16 (See at least FIG. 4C). Although, 3 patterns are illustrated patterns greater or less than 3 may be used and are considered to be within the scope of various embodiments of the present invention. Still further, more or less than four openings 34 may be employed.

Figure 5:
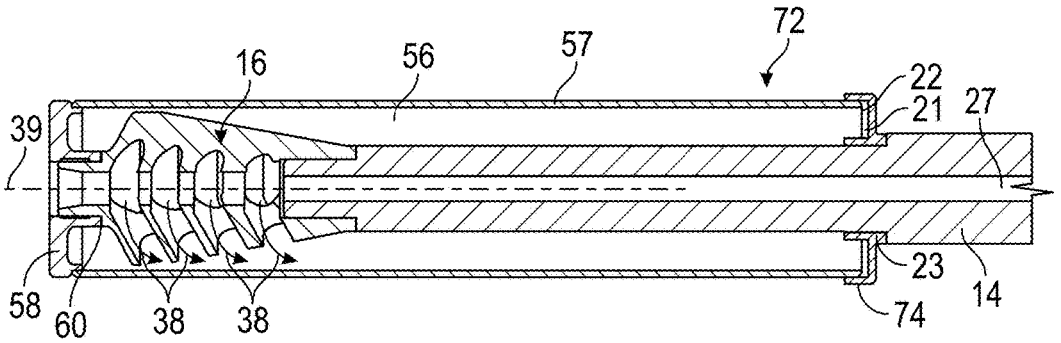
FIG. 5 is a cross sectional view of the suppressor.
Figure 5A:
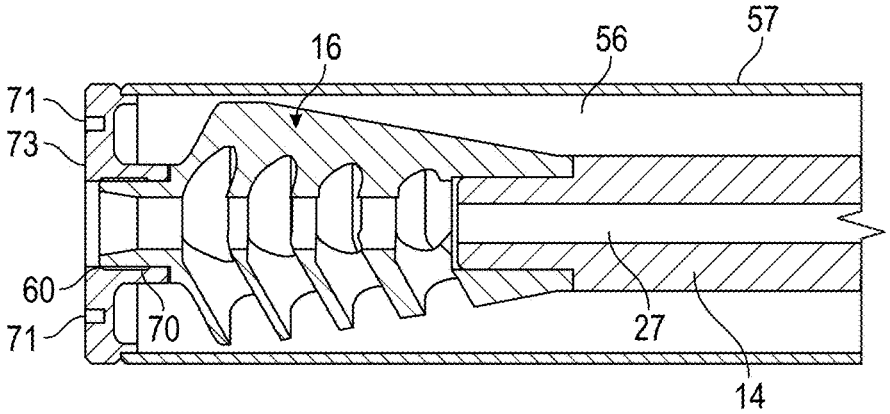
FIG. 5A is an enlarged view of a portion of FIG. 5.
Figure 5B:
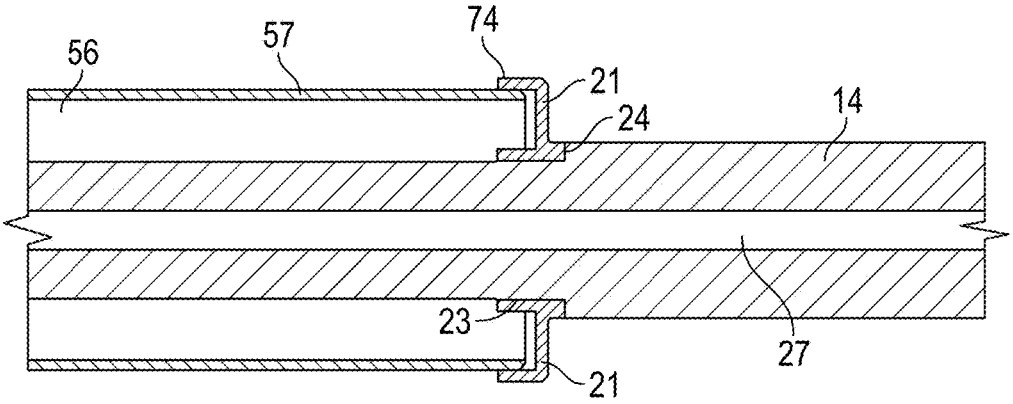
FIG. 5B is an enlarged view of another portion of FIG. 5.
Figure 6:
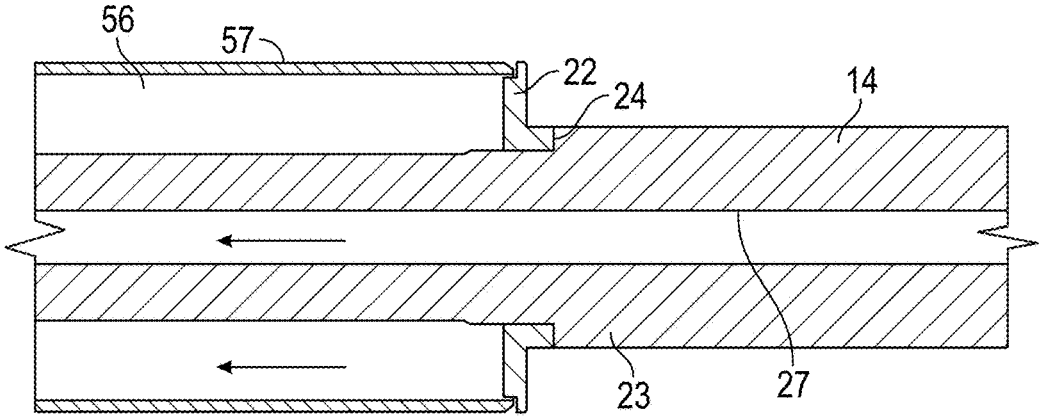
FIG. 6 is an enlarged view of a rear portion of the suppressor according to an alternative embodiment.
Figure 7:
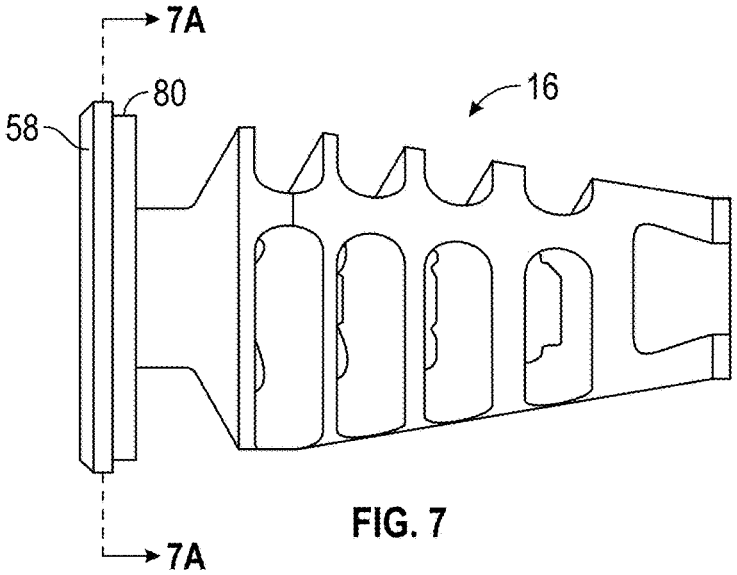
FIG. 7 is a view of a baffle of the suppressor according to an alternative embodiment.
Figure 7A:
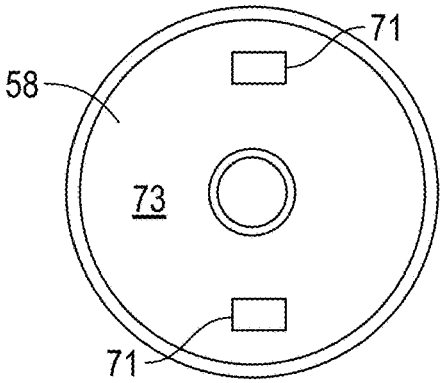
FIG. 7A is a view along lines 7A-7A of FIG. 7.

Referring now to at least FIG. 5, the suppressor or suppressor assembly 10 includes an internal expansion chamber 56 that is defined by a housing 57 that is secured to barrel 14 via seal plate 22 and a front end cap 58 that is secured to the baffle 16 and a forward end of the housing 57. In accordance with one embodiment, the housing 57 is a tubular body and the front end cap 58 is fixedly secured to the front end of the tubular body 57 via a welding process or any other suitable means for securing cap 58 to body 57. In this embodiment, the front end cap 58 is provided with a threaded opening 60 configured to threadingly engage a threaded portion 70 of the baffle 16.

Accordingly, the suppressor or suppressor assembly 10 comprising baffle 16 and housing 57 with its end cap 58 is secured to the barrel 14 of the firearm 14. As such, the housing 57 with one closed end (end cap 58) having a concentrically located threaded hole 60 is installed over the baffle 16 and barrel 14. In order to rotationally secure end cap 58 to the threaded portion 70 of the baffle 16, tool engagement openings 71 may be located on a forward surface 73 of the end cap 58 so that housing 57 and end cap 58 may rotate about axis 39 as they are secured to baffle 16. Here the baffle 16 is first secured to barrel 14 and then the end cap 58 and housing 57 are secured to baffle 16. Positive retention of the housing 57 may be achieved by either a constant torque washer, pinning or supplemental retention device to prevent inadvertent loosening during operation or handling. When installed a rearward end 72 of the housing 57 interfaces with the rear seal 22 via a concentric step feature that comprises an outer wall portion 74 of "U" portion 21. In this embodiment, a small amount of gas leakage is allowed to occur between outer wall portion 74 of "U" portion 21.

When the firearm 12 is discharged, rapidly expanding high velocity gases can either precede the projectile via leakage phenomena between the projectile and bore 27, with a more substantial release following the exit of the projectile from the muzzle 18. For the sake of this discussion, both of these will be considered as the same, and their interaction with the suppressor or suppressor assembly 10, consistent.

As the gas flow field exits the muzzle 18, it expands into the space created by the set of the first three annular passageways 42. The toroidal geometry at the transition between the central bore and the passageways encourages the transition to the passageways. This gas flows outwards to the smallest diameter set of exits from the baffle, closest to the muzzle axially. These gases are directed rearward into the volume contained or defined by the expansion chamber 56.

The gases that do not travel out the first set of passageways 42, continue through the central bore 32 and expand into the second gap or second set of passageways 44, in identical fashion to the first set of passageways 42. The escaping gases have a separate and discrete set of pathways to the expansion chamber 56. The conical geometry of the baffle 16, results in direct pathways to the interior of the expansion chamber 56 volume for all subsequent sets.

Gas entering the expansion chamber 56 may escape partially through joints between the rear seal 22 and the rear end of the housing 57 defining the expansion chamber 56.

The escaping gases will eventually reverse direction as the transient pressure conditions change, leaving the residual pressure in the expansion chamber 56 being higher than that at the muzzle 18. The gas will eventually exhaust from the suppressor or suppressor assembly 10 back to ambient conditions.

In an alternative embodiment, the rearward end 72 of the housing 57 is completely sealed about its periphery to the rear seal 22. For example, an alternative configuration of rear seal 22 is illustrated in FIG. 5 and the end 72 is welded completely about its periphery to rear seal 22 thus providing a hermetic or air tight seal between the end 72 and rear seal 22.

In addition and in this embodiment, baffle 16 is configured to have an integral end cap 58 and thus baffle 16 and its integral end cap 58 may be secured to the threaded end 28 of the barrel 14 by rotating the same about axis 39. In this embodiment, the forward end of the housing 57 sits upon a peripheral edge 80 of the integral end cap 58 of baffle 16.

In accordance with various embodiments of the present invention, all passages for gas flow are exposed to the expansion chamber 56. The conical geometry of the monolithic baffle 16 inherently provides direct access from all annular gas vents 42, 44, 52, and 54 to the expansion chamber 56. Accordingly, there are not multiple discrete sealed volumes or labyrinth passageways as in other suppressors.

The axially inclined passageways from the central bore 32 to an exterior surface 38 of the baffle 16 complete with toroidal transitions are all manufactured from a single monolithic piece. In addition and in one embodiment, the wall thickness between these passageways is incremented to be thickest at first transition closest to the muzzle end 18 in order to improve the life expectancy of the part, with thinner subsequent walls further away from the muzzle end 18 in the pattern to optimize it for weight.

Embodiments of the invention has been described above, but it will be apparent to a reader skilled in the art that alterations, modifications and variations can be effected to the particular embodiments without departing from the scope of the invention, which is defined solely by the claims appended hereto. For example, it will be understood by persons of ordinary skill in the art that the dimensions may be appropriately scaled for firearms of different calibers.

What is claimed is:

1. A suppressor assembly for use with a firearm, comprising:

a baffle having a concentric bore extending therethrough from a threaded opening and a series of annular passageways extending from the concentric bore to a tapered exterior surface of the baffle, the series of annular passageways being axially inclined rearward with respect to a rearward end of the baffle;

a rear seal plate;

a housing; and a front end cap, wherein the housing, the rear seal plate and the front end cap define an expansion chamber for receipt of expansion gases received from the baffle.

2. The suppressor assembly as in claim 1, wherein the baffle is a monolithic structure and has a cone shape that increases in diameter as the baffle extends forwardly towards, the front end cap.

3. The suppressor assembly as in claim 1, wherein the series of annular passageways comprise 4 annular passageways that repeat in a pattern axially about the bore of the baffle.

4. The suppressor assembly as in claim 3, wherein each of the annular passageways are separated by a plurality of wall portions that reduce sequentially in thickness from the rearward end of the baffle.

5. The suppressor assembly as in claim 4, wherein the front end cap is integrally formed with the baffle.

6. The suppressor assembly as in claim 1, wherein the baffle is a monolithic structure and it is formed from a single monolithic piece.

7. In combination, a suppressor assembly and a firearm with a barrel, the suppressor assembly comprising:

a baffle having a concentric bore extending therethrough from a threaded opening and a series of annular passageways extending from the concentric bore to a tapered exterior surface of the baffle, the series of annular passageways being axially inclined rearward with respect to a rearward end of the baffle, wherein the baffle is in fluid communication with a muzzle end of the barrel;

a rear seal plate secured to a step feature of the barrel;

a housing; and a front end cap, wherein the housing, the rear seal plate and the front end cap define an expansion chamber for receipt of expansion gases received from the baffle.

8. The combination of claim 7, wherein the baffle is a monolithic structure and has a cone shape that increases in diameter as the baffle extends forwardly from the muzzle end of the barrel towards the front end cap.

9. The combination of claim 8, wherein the series of annular passageways comprise 4 annular passageways that repeat in a pattern axially about the bore of the baffle.

10. The combination as in claim 9, wherein each of the annular passageways are separated by a plurality of wall portions that reduce sequentially in thickness from a rearward end of the baffle.

11. The combination as in claim 7, wherein each of the annular passageways are separated by a plurality of wall portions that reduce sequentially in thickness from a rearward end of the baffle.

12. The combination as in claim 7, wherein the front end cap is integrally formed with the baffle.

13. The combination as in claim 7, wherein the baffle is a monolithic structure and it is formed from a single monolithic piece.

14. The combination as in claim 7, wherein the rear seal plate has a "U" shaped configuration that surrounds a central opening that is secured to the step feature of a barrel.

15. The combination as in claim 7, wherein the rear seal plate has a ledge that is welded to the housing of the suppressor assembly.

16. A method for suppressing muzzle flash of a firearm, comprising:

directing combustion gases of the firearm rearwardly from a muzzle end of a barrel of the firearm into an expansion chamber located about the barrel through a baffle secured to the muzzle end of the barrel, wherein the baffle is a monolithic structure and has a cone shape that increases in diameter as the baffle extends forwardly towards a front end cap secured to the baffle and a housing that defines the expansion chamber and wherein the baffle has a concentric bore extending therethrough from a threaded opening and a series of annular passageways extending from the concentric bore to a tapered exterior surface of the baffle, the series of annular passageways being axially inclined rearward with respect to a rearward end of the baffle, wherein the front end cap is a separate unit fixedly attached to the housing.

* * * * *